US006158814A

United States Patent [19]

Cole

[11] Patent Number: 6,158,814

[45] Date of Patent: Dec. 12, 2000

[54] UNITARY SEATING DEVICE FOR COMPENSATING FOR PELVIC TILT

[76] Inventor: Lee Cole, 2514 Great Hwy., San Francisco, Calif. 94116

[21] Appl. No.: 08/917,136

[22] Filed: Aug. 25, 1997

[51] Int. Cl.[7] ..... A47C 7/02

[52] U.S. Cl. ..... 297/452.23; 297/452.21

[58] Field of Search ..... 297/202, 195.1, 297/452.21, 452.23, 452.24, 452.26, 453.41, 452.28; 5/652, 600; 128/115.1

[56] References Cited

U.S. PATENT DOCUMENTS

| | | | |
|---|---|---|---|
| 645,256 | 3/1900 | Garford | 297/202 |
| 3,587,569 | 6/1971 | Madsen | 297/284.1 X |
| 4,377,308 | 3/1983 | Pisanu | 297/452.26 X |
| 4,824,169 | 4/1989 | Jarrell | 297/452.26 X |
| 5,105,489 | 4/1992 | Meyer | 297/452.23 X |
| 5,415,460 | 5/1995 | Laney | 297/423.41 |
| 5,823,618 | 10/1998 | Fox et al. | 297/202 X |
| 5,833,708 | 11/1998 | Czaplak | 297/423.41 X |

FOREIGN PATENT DOCUMENTS

| | | | |
|---|---|---|---|
| 96249 | 2/1898 | Germany | 297/284.3 |
| 2019141 | 11/1971 | Germany | 297/284.3 |
| 2117330 | 10/1972 | Germany | 297/452.21 |
| 3223197 | 12/1983 | Germany | 297/452.21 |
| 3616970 | 11/1987 | Germany | 297/423.41 |
| 9210118 | 6/1992 | WIPO | 297/284.3 |

*Primary Examiner*—Milton Nelson, Jr.
*Attorney, Agent, or Firm*—Edward Callahan

[57] ABSTRACT

A device for increasing comfort for a human in the sitting position that includes a unitary seat cushion having right and left side cushion portions for supporting the right and left innominate bones, respectively, of a user. Each right and left cushion portion has horizontal top and bottom walls that are separated by vertical distances, one of the vertical distances is preselected to be greater than the other vertical distance by a preselected distance that generally ranges between 1/16 inch and 1/8 inch.

8 Claims, 10 Drawing Sheets

UNITARY SEATING DEVICE FOR COMPENSATING FOR PELVIC TILT

FIELD OF THE INVENTION

This invention relates to the field of seat cushions for providing greater comfort for humans in the sitting position.

BACKGROUND OF THE INVENTION

Anthropologists have noted that many humans have developed a functionally long leg, generally the left leg. The right and left legs in fact are of the same length but the pelvic bone is often tilted slightly higher on the left side than the left side. The difference in functional leg length is estimated to be in the general range of 1/16 inch to 1/8 inch but sometimes greater. This condition is designated herein as pelvic tilt. It is theorized that it could be a result of prehistoric evolutionary forces involved with survival techniques related to greater stability of the human skeletal structure possibly during the act of throwing. Poor posture among humans may be due in part to a human asymmetry of the skeletal structure caused by the pelvic tilt. The asymmetry can also cause three-dimensional torsional forces upon the pelvis that can also result in a slight forward displacement of the bottom area of the right side of the pelvis. The problem caused by pelvic tilt can be said to be primarily one of a varying degree of discomfort during standing, walking, and sitting, especially as a person grows older.

SUMMARY OF THE INVENTION

Accordingly, it is an object of this invention to provide a seat cushion, or seat pad, for a user in the seated position that adjusts the forward tilt of the underside of the pelvic bowl to a more normal position so that the lumbar area of the spine readjusts to a more normally curved position with the result that the comfort level of the user is increased.

It is a further object of this invention to provide a seat cushion, or seat pad for a human in a sitting position including sitting in a chair or on a bench, or on the seat of a motor vehicle, bicycle, motorcycle, or other such objects that call for sitting that increases the comfort level of the user by causing the underside of the pelvic bowl to be restored from a forwardly displaced position to a more natural position with the result that the lumbar area of the spine readjusts to a more natural curved position.

In accordance with these and other objects that will become apparent in the course of this disclosure, there is provided a device for increasing comfort for a human in the sitting position that includes a unitary seat cushion, or seat pad, made of a firm material known in the art of cushion making. The cushion includes right and left side cushion portions for supporting the right and left buttocks, and in particular the right and left pelvic innominate bases of the left and right innominate bones of a user. Either the right side cushion portion or the left side cushion portion is preselected to have the greater vertical material thickness in accordance with the orientation of the preexisting functionally shorter leg of the user. The difference in vertical thicknesses is a specified or preselected distance, which is generally about 3/32 inch but can range from 1/16 inch to 1/8 inch or at times a greater distance, such as 3/16 inch, depending upon the degree of pelvic tilt and the resulting displacement of the pelvic bowl. The vertical material differences mentioned between the right side portion and the left side portion of the cushion are when the particular cushion is compressed when fully weighted. The cushion can have indications designating the right and left portions including a configuration of the cushion that indicates the proper orientation or indicia indicating orientation. The material of the cushion is a firm material and preferably in addition a somewhat flexible material. The cushion can be protected by a cover, optionally removable.

The present invention will be better understood and the objects and important features, other than those specifically set forth above, will become apparent when consideration is given to the following details and description, which when taken in conjunction with the annexed drawings, describes, illustrates, and shows preferred embodiments or modifications of the present invention and what is presently considered and believed to be the best mode of practice in the principles thereof.

Other embodiments or modifications may be suggested to those having the benefit of the teachings therein, and such other embodiments or modifications are intended to be reserved especially as they fall within the scope and spirit of the subjoined claims.

DESCRIPTION OF THE PREFERRED EMBODIMENT

Reference is now made in detail to the drawings wherein the same numerals refer to the same or similar elements throughout.

Figure 1A:
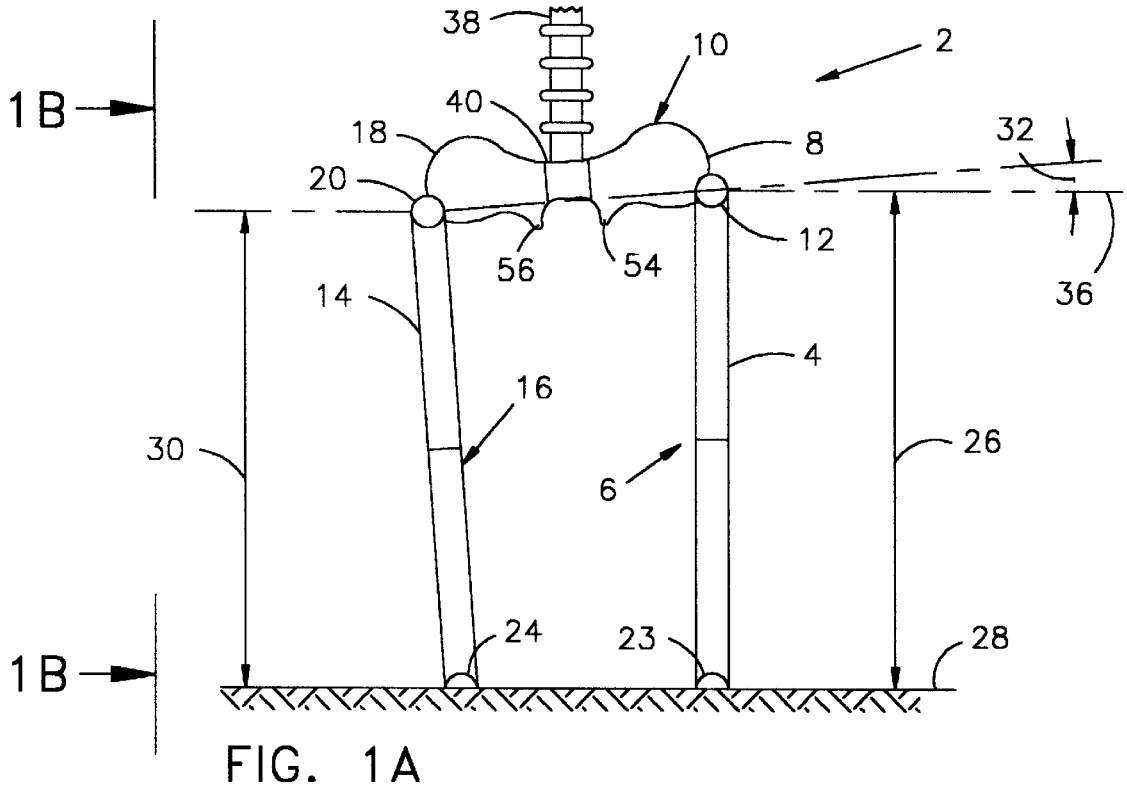
FIG. 1A is a front view of a human in a standing position that illustrates a pelvis tilt with the left leg being functionally longer than the right leg.

A schematic rendering of a front view of the lower portion of a human 2 in a standing position that illustrates a slight pelvis tilt, when such condition is present, is shown in FIG. 1A. All illustrations herein greatly exaggerate pelvic tilt for purposes of exposition. The top of left femur 4 of left leg 6 is articulated at the left innominate bone, or left hip bone, 8 of the left side of the pelvic bowl 10, at left hip joint 12. The top of right femur 14 of right leg 16 is articulated at right innominate bone, or right hip bone, 18 of pelvic bowl 10 at right hip joint 20. The actual lengths of left and right legs 6 and 16 between left and right hip joints 12 and 20 and the bottoms of left and right feet 22 and 24, respectively, are equal. The result is that pelvic bowl 10 is tilted slightly downward from left hip joint 12 to right hip joint 20. This skeletal configuration further results in right leg 16 being positioned slightly off a vertical right side distance 26 measured between right hip joint 20 and right foot 24 resting on horizontal surface 28. Left leg 6 is aligned vertical relative to left side vertical distance 30 measured between left hip joint 12 and left foot 22 resting on horizontal surface 28. The result of these two positions is that left leg 6 is functionally longer than right leg 16. The difference between right and left side vertical distances 26 and 30 vary in those individuals where a pelvic tilt is present, but in general the difference is in the range of 1/16 inch to 1/8 inch, although the latter can be greater in some cases. The actual degree of pelvic tilt is measured by a pelvic tilt angle 32 measured between the imaginary tilt line 34 between left and right hip joints 12 and 20 and imaginary horizontal line 36 that passes through left hip joint 12. The actual degree of pelvic tilt angle 32 will also vary slightly in accordance with the various dimensions of skeletal size.

Figure 1B:
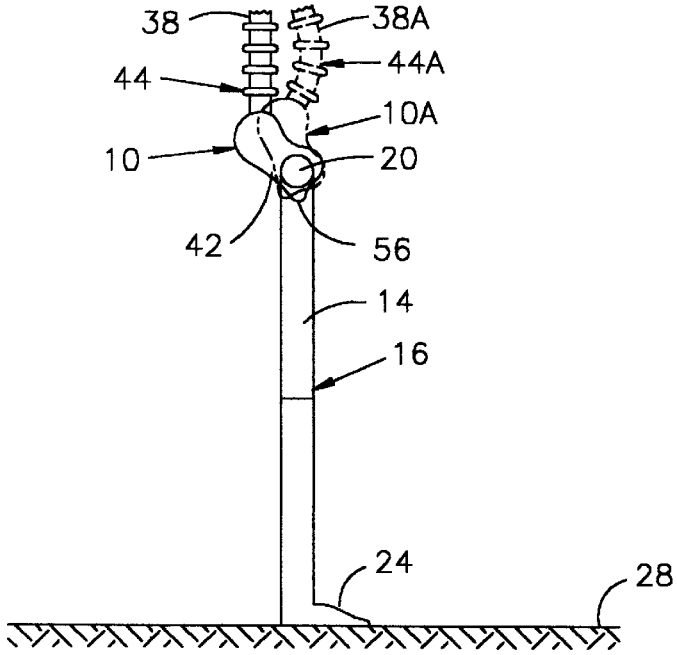
FIG. 1B is a side view of FIG. 1A illustrating the resulting unnatural positions of the pelvic bowl and of the lumbar area of the spinal cord; and in addition illustrating in phantom line the natural positions of the pelvic bowl and of the lumbar area of the spinal cord without a pelvic tilt.

Spinal column 38 extends upwardly in a generally vertical direction from spinal connection 40 at the upper area of pelvic bowl 10. The resulting position of spinal column 38 as a result of three dimensional torsional forces exerted upon pelvic bowl 10 by pelvic tilt angle 32 is indicated in FIG. 1B where the bottom portion 42 of pelvic bowl 10 is positioned slightly forward as indicated as pelvic bowl 10 in solid line. This contrasts with the structurally natural position of the pelvic bowl 10A indicated in phantom line. Another torsional force is exerted by a slightly forward position of the right innominate bone 18 from its natural position (not shown). The further result of this displacement of the natural position of pelvic bowl 10A to the displaced position of pelvic bowl 10 is the new position of spinal column 38 indicated in solid line from the former natural configuration of the spinal column which is indicated in phantom line as spinal column 38A. When the pelvic tilt is present, the lumbar area 44 of spinal column 38 is displaced slightly to a less curved position to compensate for the forward tilt of bottom portion 42, so that the former fully curved, flexible and pressure-absorbing configuration of former lumbar area 40A indicated in phantom line is reduced with resulting loss of flexibility of spinal column 38. In the natural position of the spinal column indicated as spinal column 38A, the lumbar area 40A is slightly concavely curved so as to create the natural, flexible, and pressure-absorbing configuration of spinal column 38A and shown as natural lumbar area 44A as shown in phantom line in FIG. 1B.

Figure 2:
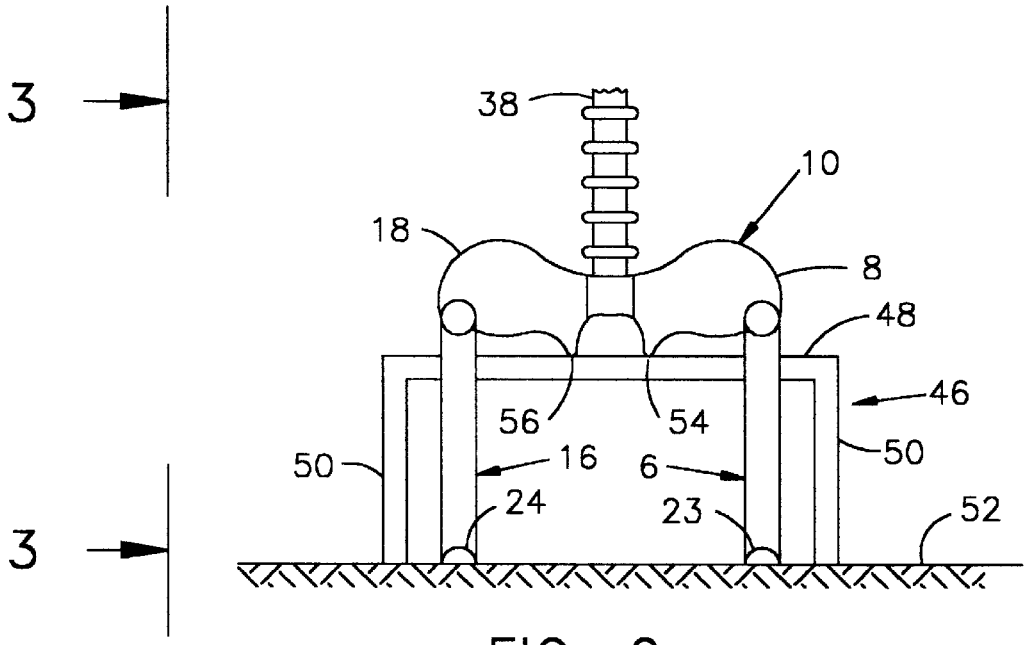
FIG. 2 is a front view of a person with the same pelvic tilt as shown in FIGS. 1A and 1B but here shown in a sitting position.
Figure 3:
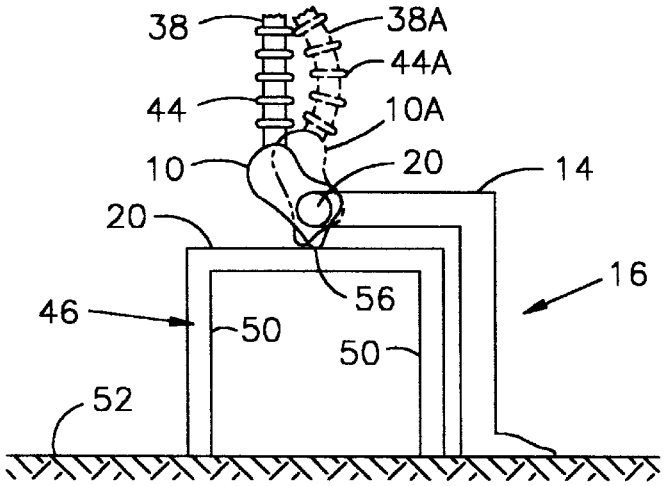
FIG. 3 is a side view of the person shown in FIG. 2 showing the resulting unnatural positions of the pelvic bowl and of the lumbar area of the spinal column as shown in FIG. 1B and showing in phantom line the natural positions of the pelvic bowl and of the lumbar area of the spine without a pelvic tilt.

FIGS. 2 and 3 show the same lower portion of the person 2 shown in FIGS. 1A and 1B in a seated position on a chair 46 with a flat seat 48 with chair legs 50 resting upon a horizontal surface 52. Left and right pelvic bases 54 and 56, respectively, rest upon horizontal seat 48. Although left and right hip joints 12 and 20 are horizontally aligned, lumbar area 44 of spinal column 38 of pelvic bowl 10 tends to retain the displacement shown in FIG. 1B as indicated in the side view shown in FIG. 3 where the bottom area of pelvic bowl 10 retains a similar forward displaced position. The natural positions of the pelvic bowl area are indicated in phantom line as pelvic bowl 10A, spine 38A, and lumbar area 44A in both FIG. 1B and in FIG. 2.

Figure 4:
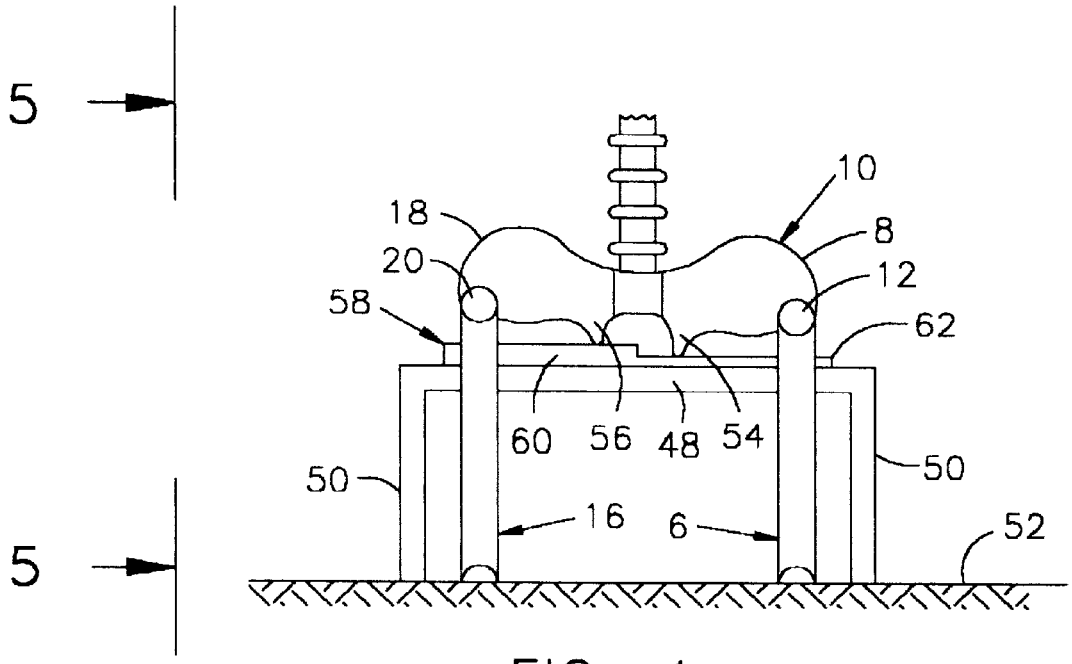
FIG. 4 is a front view of a person with the same pelvic tilt as shown in FIG. 1A and FIG. 1B and in FIG. 2 and FIG. 3 seated upon a cushion in accordance with the present invention with a raised right portion supporting the right innominate bone of the pelvic bowl.
Figure 5:
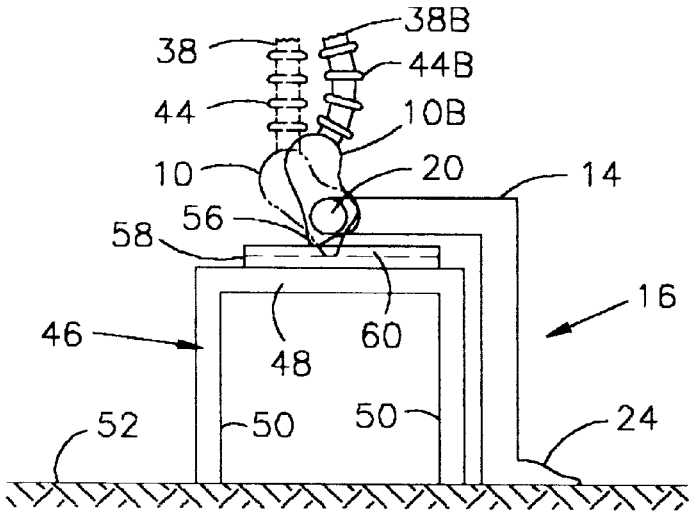
FIG. 5 is a right side view taken though plane 5—5 of FIG. 4 showing the person seated upon the cushion shown in FIG. 4 illustrating the resulting restored natural positions of the pelvic bowl and of the lumbar area of the spinal column with the former unnatural positions of the pelvic bowl and of the lumbar area of the spinal column shown in phantom line.

In accordance with the present invention, FIGS. 4 and 5 show frontal and right side views of human 2 with the same pelvic tilt as shown in FIGS. 1A and 1B and in FIGS. 2 and 3 now seated upon a cushion 58 placed on chair 46. The resulting restored natural positions are indicated as pelvic bowl 10B, spine 38B, and lumbar area 44B rendered in solid line as contrasted with the former displaced positions indicated in phantom line as pelvic bowl 10, spinal column 38, and lumbar area 44. Cushion 58 includes a raised right side portion 60 and a left side portion 62 as designated from the perspective of person 2. Right and left side portions 60 and 62 have adjoining right and left flat bottom sides, or walls, 64 and 66, respectively, that lie in the same horizontal plane.

Figure 6:
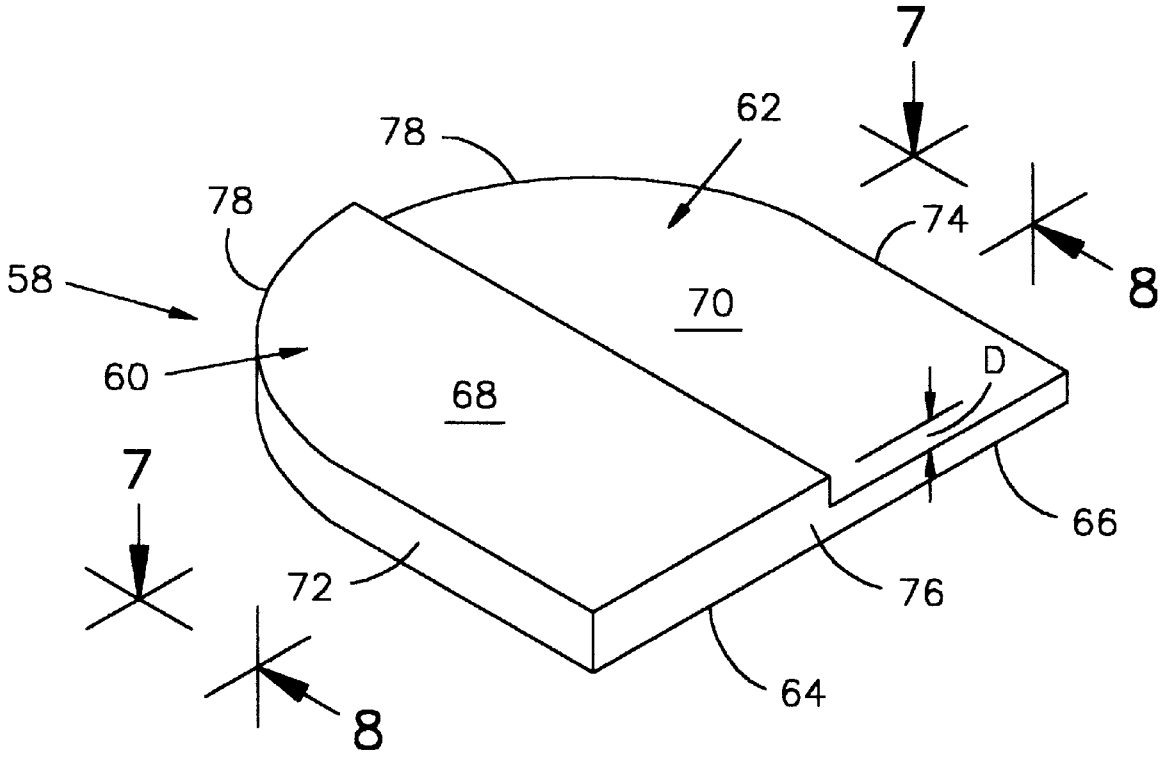
FIG. 6 shows a perspective view in isolation the same cushion illustrated in FIGS. 4 and 5 with the raised right side portion extending upwardly from the cushion relative to the left side portion.
Figure 7:
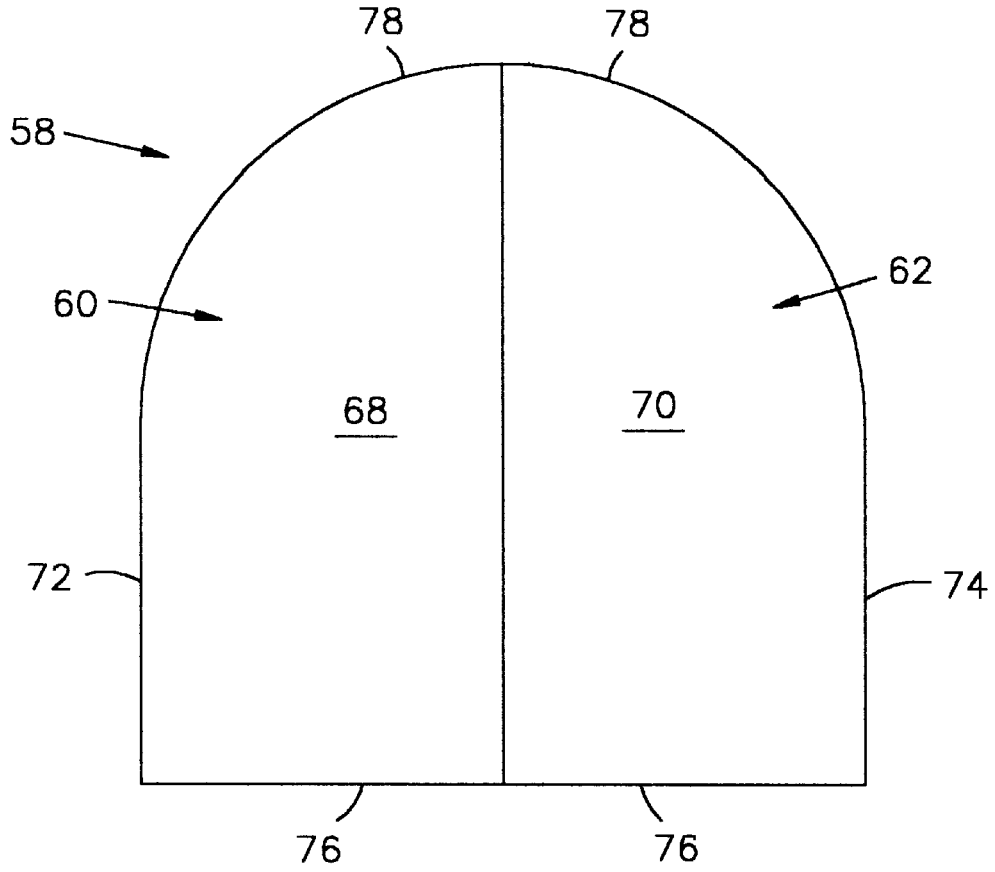
FIG. 7 shows a top view of the cushion taken through plane 7—7 of FIG. 6.
Figure 8:
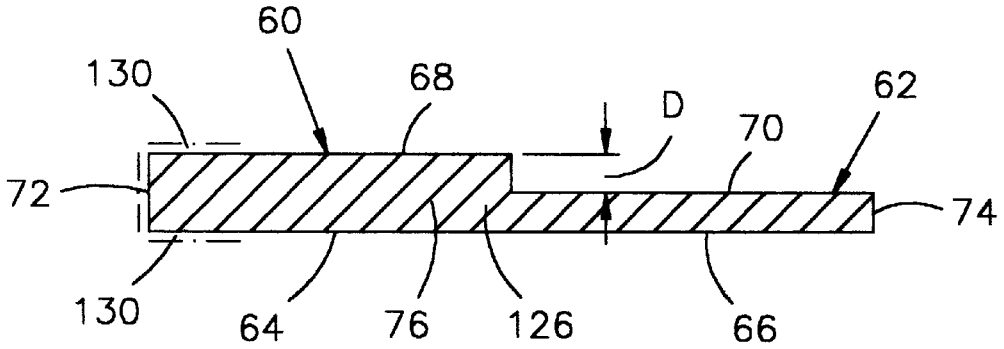
FIG. 8 shows a sectional side view taken through plane 8—8 of FIG. 6.

FIGS. 6, 7, and 8 show cushion 58 with right side portion 60 having a flat right top side 68 that lies in a plane generally parallel to right and left bottom sides 64 and 66 that lie in the same horizontal plane. Right top side 68 lies in a horizontal plane raised at a distance D from and parallel to the horizontal plane of left top side 70. Distance D can vary generally between 1/16 inch and 1/8 inch, although 3/16 inch or even more can be preferred at times. Distance D is when cushion 58 is compressed or fully weighted. Distance D corrects the forward rotation of the bottom area from the displaced pelvic bowl 10. The thickness of cushion 58 between right top side 68 and right bottom side 64 and left top side 70 and left bottom side 66 can vary within the art of flat cushions for hard bottom chairs or similar use cushions in the art of cushions and is related to the material used to make cushion 58, which is preferably made of a firm yet flexible material so that cushion 58 can somewhat adjust to different seats and chairs. Cushion 58 includes opposed generally parallel right and left side edges 72 and 74, respectively, normal to right and left top and bottom sides 64, 66, 68, and 70 and a straight front edge 76 normal to both right and left side edges 72 and 74 and to top and bottom sides 64, 66, 68, and 70. Cushion 58 also includes a convex rear edge 78 opposed to front edge 76 contoured in accordance with the general contour of the rear area of chairs. Rear edge 78 is normal to bottom and top sides 64, 66, 68, and 70.

When right hip bone 18 is raised by right side portion 60 with right pelvic base 56 likewise being raised, the bottom portion of pelvic bowl 10 is rotated rearward, with the result that right femur 14 tends to rest in bearing contact upon right side portion 60 of cushion 58 in contrast to right pelvic base 56 being in primary bearing contact with seat 48 as shown in FIG. 3. This new alignment of right pelvic base 56 results in a restored natural curvature of lumbar area 44B with the result that spinal column 38B is restored to its natural resiliency.

Figure 6A:
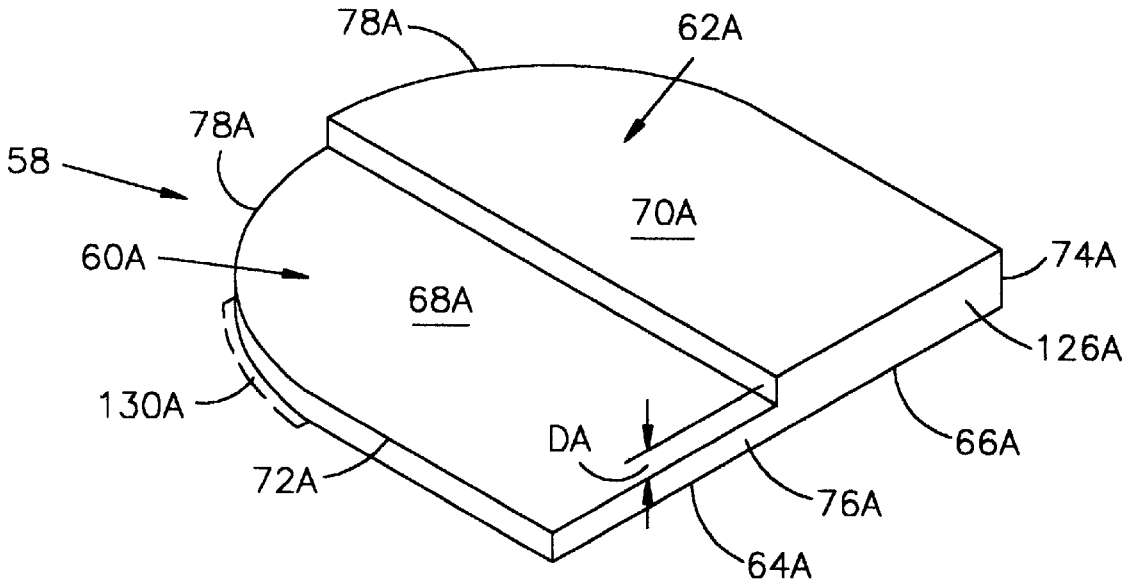
FIG. 6A shows a perspectively view in isolation of a cushion analogous to the cushion illustrated in FIG. 6 with the difference that the left side portion of the cushion is raised extending upwardly from the cushion relative to the right side portion.

FIG. 6A shows a cushion 58A with an orientation opposite to that of cushion 58 shown in FIG. 6 that is used in such a case when the right leg of a person is functionally longer than the left leg, that is, opposite to the structure shown in FIG. 1A. Cushion 58A includes a right side portion 60A having a flat right top side 68A that lies in a plane generally parallel to right and left bottom sides 64A and 66A that lie in the same horizontal plane. Right top side 68A lies in a horizontal plane at a distance DA down from and parallel to the horizontal plane of left top side 70A. Distance DA can vary generally between 1/16 inch and 1/8 inch, although 3/16 inch or even more can be preferred at times. Distance DA is when cushion 58A is compressed or fully weighted. Distance DA corrects the forward rotation of the bottom area from the displaced pelvic bowl 10. The thickness of cushion 58A between right top side 68A and right bottom side 64 and left top side 70A and left bottom side 66A can vary within the art of flat cushions for hard bottom chairs or similar use cushions in the art of cushions and is related to the material used to make cushion 58A, which is preferably made of a firm yet flexible material so that cushion 58A can somewhat adjust to different seats and chairs. Cushion 58A includes opposed generally parallel right and left side edges 72A and 74A, respectively, normal to right and left top and bottom sides 64A, 66A, 68A, and 70A and a straight front edge 76A normal to both right and left side edges 72A and 74A and to top and bottom sides 64A, 66A, 68A, and 70A. Cushion 58A also includes a convex rear edge 78A opposed to front edge 76A contoured in accordance with the general contour of the rear area of chairs. Rear edge 78A is normal to bottom and top sides 64A, 66A, 68A, and 70A.

Figure 9:
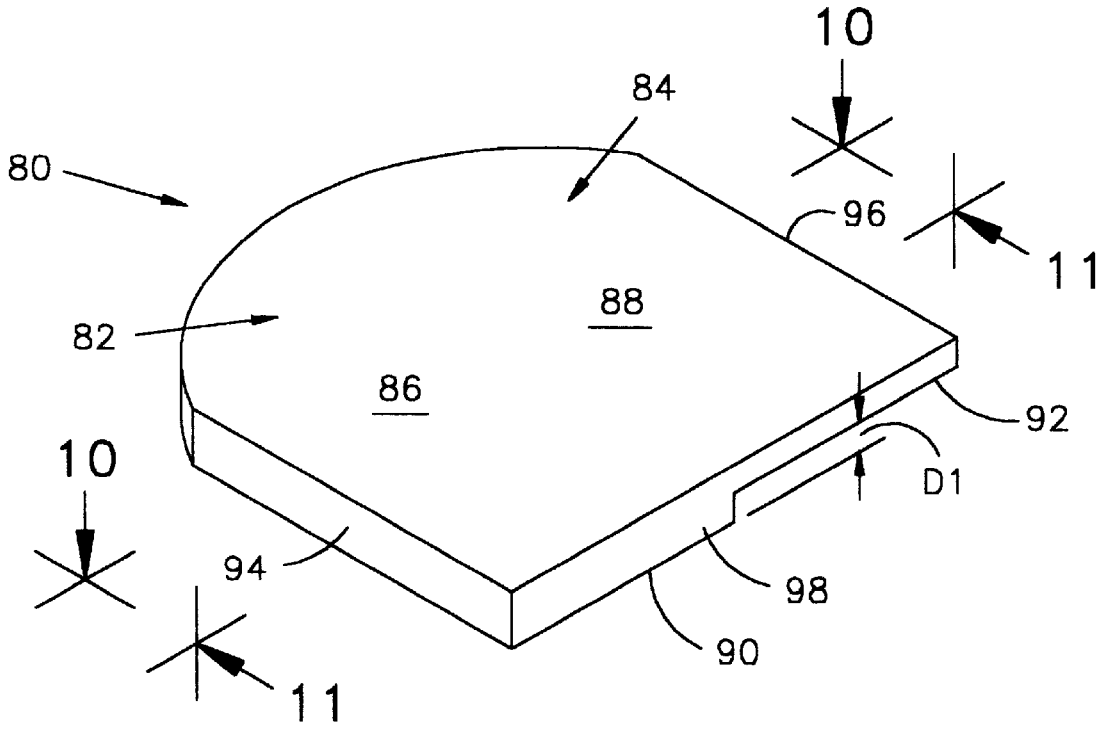
FIG. 9 shows a perspective view in isolation of another embodiment of the cushion shown in FIG. 6 with a right side portion analogous to the raised right side portion of FIG. 6 but with the difference that the right side portion extends downwardly relative to the left side portion.
Figure 10:
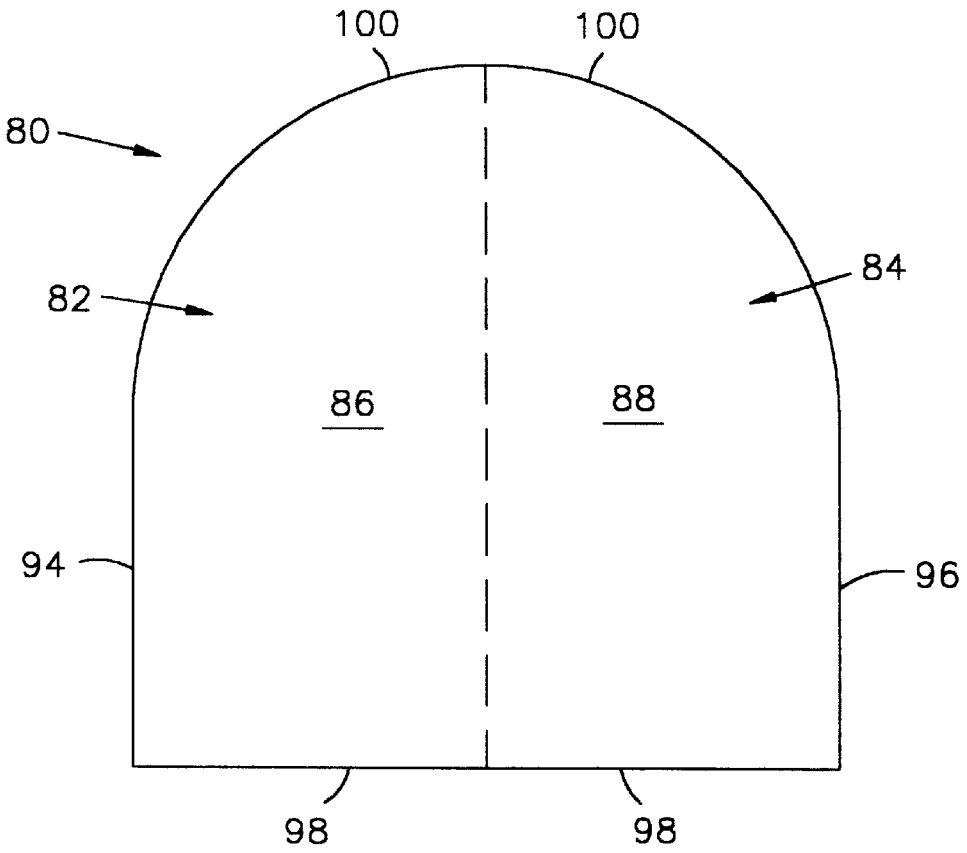
FIG. 10 is a top view taken through plane 10—10 of FIG. 9.
Figure 11:
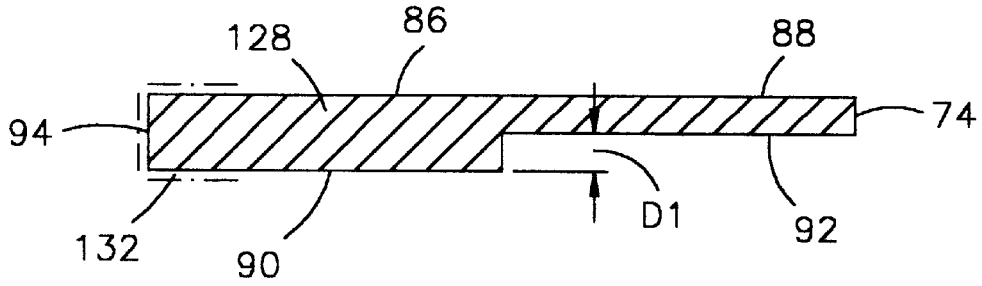
FIG. 11 is a sectional view taken through plane 11—11 of FIG. 9.

Another embodiment in accordance with the present invention analogous to cushion 58 shown in FIGS. 4–8 is shown in FIGS. 9, 10, and 11 and is designated therein as cushion 80.

Cushion 80 includes a right side portion 82 and a left side portion 84 as designated from the perspective of a person sitting thereon. Right and left side portions 82 and 84 have adjoining right and left flat top sides, or walls, 86 and 88, respectively, that lie in the same horizontal plane.

Right side portion 82 has a flat right bottom side, or wall, 90 that lies in a plane generally parallel to right and left top sides 86 and 88 and also that lies in a horizontal plane at a distance D1 that is lower from and parallel to the horizontal plane of left bottom side, or wall, 92. Distance D1 can vary generally between 1/16 inch and 1/8 inch, although 3/16 inch or even more can be preferred at times. Distance D1 is when cushion 80 is compressed or fully weighted. Distance D1 provides an adjustment of the pelvic tilt and more importantly of an adjustment of the forward rotation of the underside of the pelvic bowl of the person using cushion 80. The thickness of cushion 80 between right top side 86 and right bottom side 90 and left top side 88 and left bottom side 92 can vary within the art of flat cushions for hard bottom chairs or similar use cushions in the art of cushions and is related to the material used to make cushion 80, which is preferably made of a firm yet flexible material so cushion 80 can somewhat adjust to different seats and chairs. Cushion 80 includes opposed generally parallel right and left side edges 94 and 96, respectively, normal to right and left top and bottom sides 86, 88, 90, and 92 and a straight front edge 98 normal to both right and left edges 94 and 96 and to top and bottom sides 86, 88, 90, and 92. Cushion 80 also includes a convex rear edge 100 opposed to front edge 98 and contoured in accordance with the general contour of the rear area of chairs. Rear edge 100 is normal to bottom and top sides 86, 88, 90, and 92.

Figure 9A:
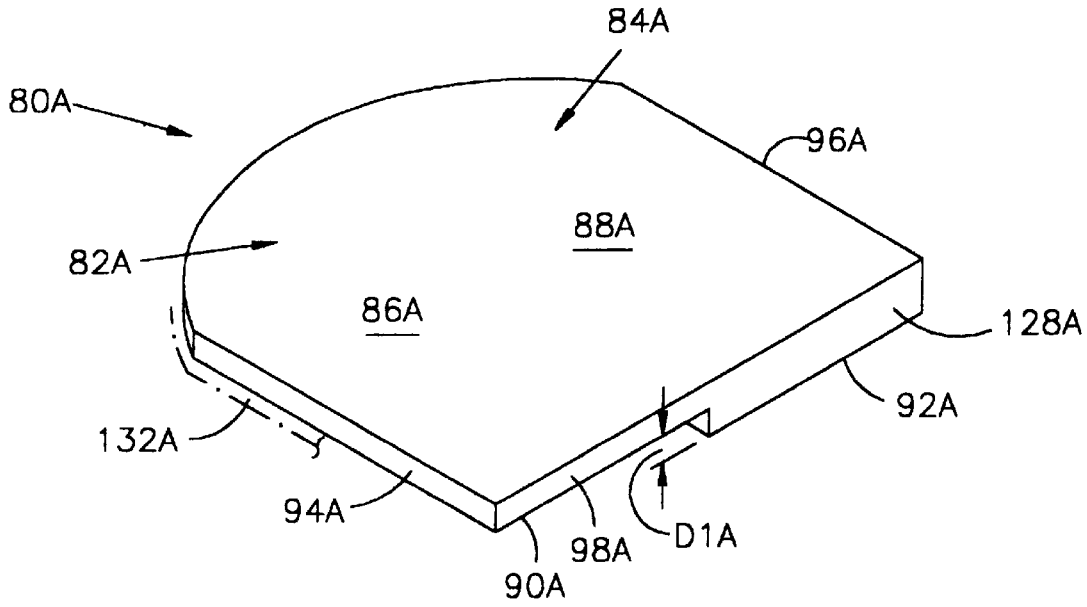
FIG. 9A shows a perspective view in isolation of a cushion analogous the cushion shown in FIG. 6A with the difference that the left side portion extends downwardly relative to the right side portion.

FIG. 9A shows a cushion 80A with an orientation opposite to that of cushion 80 shown in FIG. 9 that is used in such a case when the right leg of a person is functionally longer than the left leg, that is, opposite to the structure shown in FIG. 1A.

Cushion 80A includes a right side portion 82A and a left side portion 84A as designated from the perspective of a person sitting thereon. Right and left side portions 82A and 84A have adjoining right and left flat top sides, or walls, 86A and 88A, respectively, that lie in the same horizontal plane. Right side portion 82A has a flat right bottom side, or wall, 90A that lies in a plane generally parallel to right and left top sides 86A and 88A and also that lies in a horizontal plane at a distance D1 that is lower from and parallel to the horizontal plane of left bottom side, or wall, 92A. Distance D1 can vary generally between 1/16 inch and 1/8 inch, although 3/16 inch or even more can be preferred at times. Distance D1 is when cushion 80A is compressed or fully weighted. Distance D1 provides an adjustment of the pelvic tilt and more importantly of an adjustment of the forward rotation of the underside of the pelvic bowl of the person using cushion 80A. The thickness of cushion 80A between right top side 86A and right bottom side 90A and left top side 88A and left bottom side 92A can vary within the art of flat cushions for hard bottom chairs or similar use cushions in the art of cushions and is related to the material used to make cushion 80, which is preferably made of a firm yet flexible material so cushion 80A can somewhat adjust to different seats and chairs. Cushion 80A includes opposed generally parallel right and left side edges 94A and 96A, respectively, normal to right and left top and bottom sides 86A, 88A, 90A, and 92A and a straight front edge 98A normal to both right and left edges 94A and 96A and to top and bottom sides 86A, 88A, 90A, and 92A. Cushion 80A also includes a convex rear edge 100A opposed to front edge 98A and contoured in accordance with the general contour of the rear area of chairs. Rear edge 100A is normal to bottom and top sides 86A, 88A, 90A, and 92A.

Cushions 58, 58A, 80, and 80A are unitary and thus portable, but within the spirit of the invention each can be connected to or be integral with a chair or seat.

Figure 12:
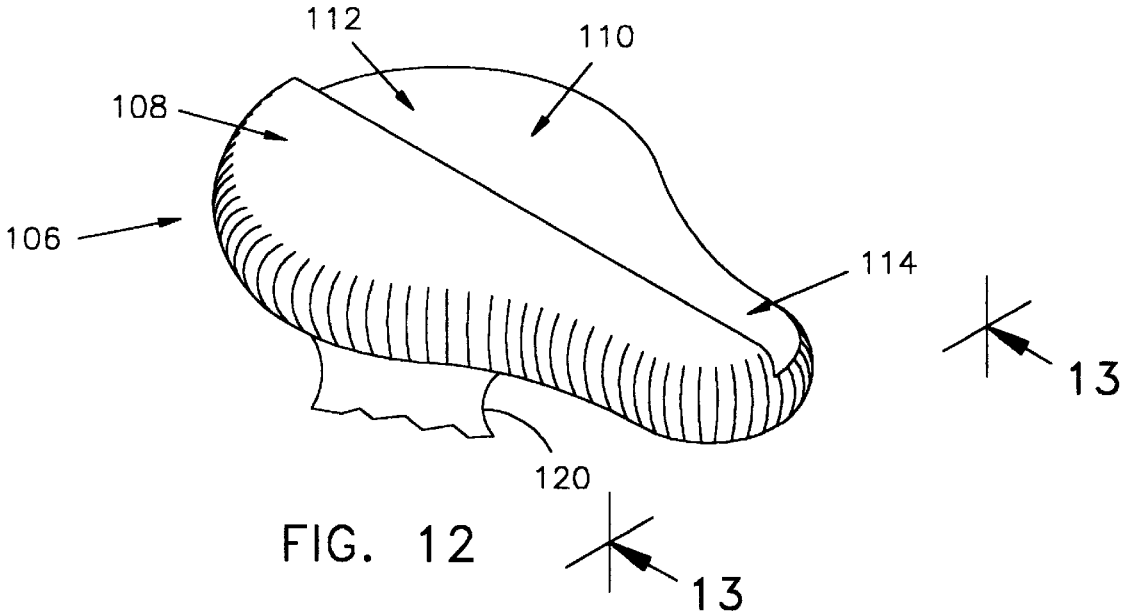
FIG. 12 shows a perspective view of a cushion with a thicker right side portion relative to the left side portion in the configuration of a saddle seat of a one occupant vehicle such as for seating the operator of a motorcycle or a bicycle.
Figure 13:
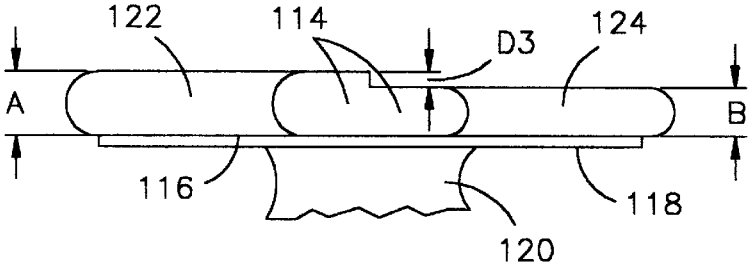
FIG. 13 is a front view taken through plane 13—13 of FIG. 12.

In accordance with the present invention, a saddle seat 106 of the type used to seat the operator of a motorcycle or a bicycle or other such analogous type of vehicle is shown in FIGS. 12 and 13. Saddle seat 106 has right and left portions 108 and 110 and rear and front portions 112 and 114, respectively. Rear portion 112 is broader than front portion 114 as is the case in the art of saddle seats. Rear portion 112 is positioned to seat both the right and left buttocks by way of the right and left pelvic bases of a user.

Right and left side portions 108 and 110 are positioned to support the right and left buttocks, respectively, of a user, that is, the right and left pelvic bases of a user. The underside 116 of saddle seat includes a support base 118 that is connected to a post 120 that is connected to the frame of the vehicle in a manner known in the art of motorcycles, bicycles, and other such vehicle.

Right side portion 108 has a right top side 122 that extends to underside 116 and left side portion 110 has a left top side 124 that extends to underside 116. The thickness of right side portion 108 between right top side 122 and underside 116 is a distance A and the thickness of left side portion 110 between left top side 124 and underside 116 is a distance B. The difference in distances A and B is the distance D3. Distance D3 can vary generally between 1/16 inch and 1/8 inch, although 3/16 inch or even more can be preferred at times. Distance D3 is when 106 is compressed or fully weighted. Distance D3 provides an adjustment of the torsional displacement of the pelvis discussed earlier herein and particularly provides an adjustment of the forward rotation of the underside of the pelvic bowl of the person using saddle seat 106. This adjustment is the same as that provided by cushions 58 and 80 as set forth earlier in accordance with the present invention. In the example of a saddle seat 106, right top side 122 extends at the distance D3 above left top side 124, as is the case in the analogous cushion 58 described earlier.

It is possible within the spirit of the present invention that right and left top sides 122 and 124 of saddle seat 106 would be generally level with one another so that right side portion 108 extends downwardly relative to left side portion 110, a configuration generally analogous to cushion 80.

Cushions 58, 80 are made of a firm, preferably flexible material 126 and 128, respectively, and cushions 58A and 80A are likewise made of a firm, preferably flexible material 126A and 128A, respectively. Material 126 and 128 are of such vertical thickness so as to raise right side portion 60 or 82, respectively, and material 126A and 128A are of such vertical thickness so as to raise left side portion 60A or 82A, respectively, thus raising the right or left innominate bone 18 and 8, respectively.

Cushion material 126 defines horizontal right top side 68 distanced from horizontal right bottom side 64 at a first vertical distance and defines horizontal left top side 70 being distanced from horizontal left bottom side 66 at a second vertical distance, the difference between the first and second distances being the previously mentioned preselected specified distance between 1/16 inch and 1/8 inch. Likewise, cushion material 128 defines right top side 86 distanced from right bottom side 90 at a first vertical distance and defines left top side 88 distanced from left bottom side 92 at a second vertical distance, the difference between the first and second distances being the previously mentioned preselected specified distance between 1/16 inch and 1/8 inch.

Cushion material 126A defines horizontal right top side 68A distanced from horizontal right bottom side 64A at a first vertical distance and defines horizontal left top side 70A being distanced from horizontal left bottom side 66A at a second vertical distance, the difference between the first and second distances being the previously mentioned preselected specified distance DA between 1/16 inch and 1/8 inch.

Likewise, cushion material 128A defines right top side 86A distanced from right bottom side 90A at a first vertical distance and defines left top side 88 distanced from left bottom side 92A at a second vertical distance, the difference between the first and second distances being the previously mentioned preselected specified distance D1A between 1/16 inch and 1/8 inch.

All the mentioned preselected specified distances D, D1, DA, and D1A are when cushion materials 126, 126A, 128, and 128A are compressed or fully weighted.

Cushions 58 and 58A can be optionally enclosed by a suitable protective cover 130 or 130A, respectively, partially indicated in FIGS. 8 and 6A, respectively, in phantom line. Cushions 80 and 80A can be optionally enclosed by a suitable protective cover 132 or 132A, respectiely, partially indicated in FIGS. 11 and 9A, respectively, in phantom line.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims. For example, cushions 58 and 80 can be configured in various ways as can saddle seat 106. Cushions 58 and 80 can not only be unitary and portable but can be integral with seats and chairs.

What is claimed is:

1. A device for providing compensation for pelvic tilt for a user in a seated position comprising a unitary seat cushion having a right side portion and a left side portion, said right side portion having a right side bottom portion and a right side top portion with a right side vertical distance therebetween, and said left side portion having a left side bottom portion and a left side top portion with a left side vertical distance therebetween, one of said right side vertical distance and said left side vertical distance being greater than the other one of said right side vertical distance and said left side vertical distance in a preselected unit distance ranging between a unit distance of approximately 1/16 inch and a unit distance of approximately 3/16 inch, said unitary seat cushion being made of a firm material, wherein said unitary cushion is a saddle seat.

2. The device according to claim 1, wherein said right side vertical distance is greater than said left side vertical distance.

3. The device according to claim 1, wherein said left side vertical distance is greater than said right side vertical distance.

4. A device according to claim 1, wherein said right and left side bottom portions are aligned horizontally.

5. A device according to claim 1, wherein said right and left side top portions are aligned horizontally.

6. The device according to claim 1, wherein said unit distance is approximately 1/16 inch.

7. The device according to claim 1, wherein said unit distance is approximately 1/8 inch.

8. The device according to claim 1, wherein said unit distance is approximately 3/16 inch.

* * * * *